United States Patent [19]

Hellwig

[11] Patent Number: 4,920,782

[45] Date of Patent: May 1, 1990

[54] PRESS DRIVE

[75] Inventor: Waldemar Hellwig, Arbon, Switzerland

[73] Assignee: Bruderer AG, Switzerland

[21] Appl. No.: 275,411

[22] PCT Filed: Feb. 3, 1988

[86] PCT No.: PCT/CH88/00027

§ 371 Date: Oct. 3, 1988

§ 102(e) Date: Oct. 3, 1988

[87] PCT Pub. No.: WO88/05724

PCT Pub. Date: Aug. 11, 1988

[30] Foreign Application Priority Data

Feb. 3, 1987 [CH] Switzerland ..... 364/87

[51] Int. Cl.[5] ..... B21J 9/18

[52] U.S. Cl. ..... 72/451; 72/445; 72/437; 72/453.11; 100/272; 100/284; 83/630

[58] Field of Search ..... 72/450, 451, 455, 456, 72/453.3, 445, 437, 453.11; 83/630, 639; 100/272, 284, 286

[56] References Cited

U.S. PATENT DOCUMENTS

| | | | |
|---|---|---|---|
| 2,087,811 | 7/1937 | Patrick | 72/451 |
| 2,633,094 | 3/1953 | Muller . | |
| 3,000,429 | 9/1961 | Warnken | 100/272 |
| 3,682,029 | 8/1972 | Haas et al. | 83/69 |
| 4,013,003 | 3/1977 | Finsterwalder et al. | 100/286 |
| 4,302,961 | 12/1981 | Leinhaas | 72/451 |
| 4,318,325 | 3/1982 | Bareis et al. | 83/630 |
| 4,350,091 | 9/1982 | Myles | 100/271 |
| 4,419,929 | 12/1983 | Dommer et al. | 83/630 |
| 4,660,452 | 4/1987 | Leinhaas | 83/630 |

FOREIGN PATENT DOCUMENTS

| | | |
|---|---|---|
| 547236 | 3/1932 | Fed. Rep. of Germany . |
| 876797 | 5/1953 | Fed. Rep. of Germany . |
| 2111054 | 9/1972 | Fed. Rep. of Germany . |
| 2804390 | 8/1979 | Fed. Rep. of Germany . |
| 2912927 | 10/1980 | Fed. Rep. of Germany . |
| 227843 | 10/1943 | Switzerland . |
| 440980 | 1/1968 | Switzerland . |
| 807760 | 1/1959 | United Kingdom . |
| 2013562 | 8/1979 | United Kingdom . |
| 2045154 | 10/1980 | United Kingdom . |

*Primary Examiner*—David Jones

*Attorney, Agent, or Firm*—Ostrolenk, Faber, Gerb & Soffen

[57] ABSTRACT

To drive two toggle lever (29,29') of a press, in particular a high frequency cutting press with at least 400 strokes per minute, two separate but mutually synchronized drives (101,101') are provided to ensure a uniform, non-wobbling motion of the tool carrier (5). The drives (101, 101') can be rotary or linear drives and are used to drive the toggle levers (29, 29') during at least part of their motion. The energy storage (200) ensures a low energy consumption, since it stores the braking energy and supplies it again to the drive during acceleration.

29 Claims, 3 Drawing Sheets

PRESS DRIVE

BACKGROUND OF THE INVENTION

The invention relates to a press drive, for example for deep-drawing, trimming or punch presses and in particular for high-frequency punch presses with at least 500 punch movements per minute (which, as is known, must be specially designed for this purpose). In most cases, only one tool support, as a rule the upper one, is movable in such presses, although in the last analysis it is only the relative movement which is important; for this reason, it would also be possible within the scope of the invention to design both tool supports to be movable.

More particularly, the invention relates to a press drive for tool supports (5, 7) which are displaceable relative to one another, at least one of which can be driven by means of at least two toggle levers (29, 29'; 129, 129'; 229, 229'), each having two dead centers, to which toggle levers (29, 29'; 129, 129'; 229, 229') drive energy can be transmitted from one drive energy carrier in each case by means of at least one rod (4; 104, 104'; 404, 404'; 504, 504'; 604, 604'; 704), one dead center of the toggle levers (29, 29'; 129, 129'; 229, 229') determining the closest approach of the two tool supports (5, 7) which are displaceable relative to one another, the toggle levers (29, 29'; 129, 129'; 229, 229') bending in opposite directions, and the drive energy carriers being synchronized with one another via a synchronizing arrangement.

The drive of a punch press has to meet very particular requirements, since very high precision in the region of less than one hundredth of a millimeter is required, and this requirement also applies in the case of machine parts which—because of their nature—constantly vibrate and in the case of high compressive forces.

For example, "Werkzeugmaschinen" by Charcut/Tschätsch, Hauser-Verlag, 1984, page 290, presents and describes a drive having a crankshaft (the same effect could also be obtained with an eccentric shaft, either in an embodiment with a circular cam or with an orbiform curve) which drive has some advantages in this respect, since the dead center—in general the bottom dead center—determining the closest approach of the tool support is given by the peak of a sine curve, so that small tolerances in the cam adjustment have virtually no effect. However, this known drive did not meet the requirements in some respects. For example, it was not possible to reduce its mass to the desirable extent, since it was necessary to provide a flywheel to provide the necessary punching force. The arrangement of a flywheel furthermore required the use of a controllable coupling, entailing an additional component which sometimes need repairs. Furthermore, limits are imposed on the speed since the drive has to supply full acceleration each time, although part of the drive energy has to be braked again. Finally, this also results in correspondingly-large drive dimensions, which of course means high energy consumption.

SUMMARY OF THE INVENTION

The object of the invention primarily is to provide a press drive which, in any position, ensures an exactly corresponding movement sequence, dispenses with a flywheel and manages with a smaller drive and a lower energy requirement. This object is achieved, according to the invention, wherein the drive energy carriers comprise an energy store which releases stored energy in order to accelerate the masses or removes energy from the energy supply network and stores the barking energy during braking of the masses or feeds the energy back to the energy supply network (for example four-quadrant operation).

Advantageous embodiments of the invention are described herein.

By using drive elements which permit driving (acceleration) and braking (pneumatic storage of energy and feeding of current back into the network during so-called four quadrant drive), it is possible to omit not only the coupling but also any brakes. Few masses are moved during the lifting movement.

The design of the machine according to the invention, which the synchronized double toggle levers and the mass balance, thus gives rise to a novel, electronically-controllable type of press. The press described according to the invention has the following advantages over the prior art:

(1) Statically very rigid design in comparison with eccentric presses, since there are only two rods subjected to compressive force during power flow in the region of the bottom dead center;
(2) The precision of the bottom dead center can easily be maintained by a simple geometry;
(3) Dynamic stability: at each punching frequency (number of strokes/min.), the dynamic conditions are the same, i.e. the bottom dead center need not be adjusted when the punching frequency is changed;
(4) "Soft" impact during cutting, since the strike rate on the belt is considerably lower with the toggle lever principle than with eccentric presses; the cutting point is "cut", not broken;
(5) A stepless slide stroke can be chosen by virtue of the fact that the swivel bracket and piston path are adjustable;
(6) Reciprocating mass balance (first-order balance);
(7) Minimum number of moving parts (simple mechanical system);
(8) High punching frequency possible compared with conventional toggle presses and differential presses;
(9) Preselectable slide speeds;
(10) More versatile use (compared with eccentric presses);
(11) High press forces can be achieved with relatively small drive forces;
(12) Low energy requirement.

Exact guidance and tumble-free movement can be obtained by the knee hinge points of the two symmetrically arranged toggle levers (29, 29'), which are guided by means of crossheads (25, 25'), and which are engaged by the energy store (FIG. 2); and if desired, also with a single drive energy carrier, and the energy store can be fastened in a stable manner to the crossheads at a distance from the toggle levers. It should be noted here that the term "drive energy carrier" in the present description includes everything capable of delivering a drive energy, even only during part of the movement, i.e. also the energy store.

An energy store of this type can, very generally, be advantageously used completely independently of how the drive may be designed in other respects, i.e. by means of rotary drive or linear drive, and in fact even completely independently of whether two toggle lever systems are provided or not. However, an accumulator is very particularly suitable when a fluid drive is provided, as, for example, wherein at least one reversible hydraulic motor or a fluid, in particular, hydraulic cylinder/piston unit (101, 101'; 301)—coordinated with the accumulator (200; 201, 201')—is provided, and is controlable by means of at least one valve arrangement (PV) (FIGS. 3; 4; 5).

The feature wherein the drive energy carriers comprise a reciprocating drive (1; 101, 101'; 301, provides, very exactly and simply, the adjustment facility, in particular for the upper dead center, which merged in the two references mentioned at the outset. In connection with the advantageous energy store features of the invention, it is important that the reciprocating drives have a low mass, in particular in an embodiment wherein the knee hinge points of the two symmetrically rranged toggle levers (29, 29'), which are guided by means of crossheads (25, 25'), and which are engaged by the energy store (FIG. 2).

Practical tests have shown that, because of their characteristics with regard to the starting torque, hydraulic motors and asynchronous motors are particularly suitable.

BRIEF DESCRIPTION OF THE DRAWINGS

Further details are given in the following description of embodiments represented schematically in the drawing.

DETAILED DESCRIPTION

The figures are described in relation to one another. Identical parts bear the same reference numbers. Some parts which occur repeatedly are not shown (for example the energy store in FIG. 2).

Figure 2:
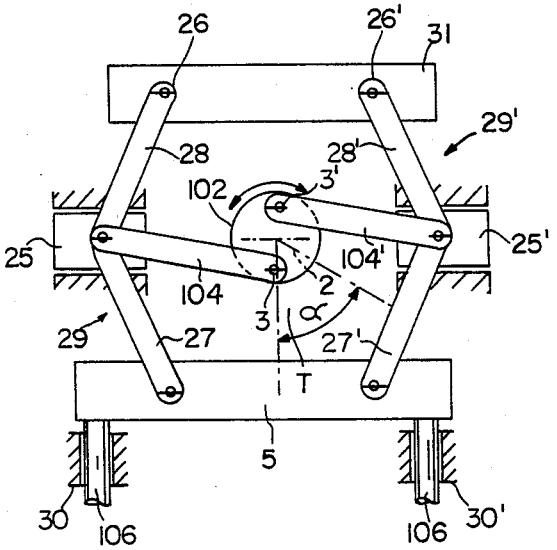
FIG. 2 shows a first embodiment having two completely symmetrical drives for both sides of a movable tool support, a crosshead guide at the hinge points of the two toggle levers additionally assuring uniform, tumble-free movement.

FIG. 2 shows a completely symmetrical drive 1 which is also particularly suitable for a reciprocating rotary drive. Two parallel crankshafts or eccentric shafts (only one of which is shown schematically as drive 1), which are in the form of flywheel-free motor shafts of a hydraulic or electric motor, provide the drive for the toggle levers 29, 29'. It has been ensured that the two shafts and drives 1 move in synchronization with one another so that the movement of the two toggle levers 29, 29' is uniform. The synchronization may be electrical synchronization, which can easily be achieved because of the pulse-dependent position of the rotors of synchronous or asynchronous motors. However, a mechanical coupling may also be present in addition or as an alternative. It would even be possible to provide only a single crankshaft (drive 1).

The design shown in FIG. 2 is also particularly suitable for a reciprocating rotary drive because there is a certain simplification by virtue of the fact that, for two strokes of the tool support 5, the angle $\alpha$ is passed through on both sides of the crankshaft dead center T (corresponding to the upper dead center of the tool support 5), which is advantageous in terms of quiet running and of energy consumption. In this case, the movement towards both sides must of course be limited by an appropriate limiting means, as will be discussed with reference to FIG. 1.

Two toggle levers 29, 29' form a scissor system for a crosshead guide structure. They are each hinged at one end to a balancing weight 31 via a bearing 26, 26'. At the other end, the toggle levers 29, 29' are hinged to a tool support 5. To assist the guidance, columns 106 in guides 30 are coordinated with the tool support 5 and, analogously to this, a guide column 32 can pass through an orifice 33 in a balancing weight 31 (FIG. 5).

The knees of the toggle levers 29, 29' are mounted on crossheads 25, 25', with the result that the movement transmitted by connecting rods 104, 104' is distributed above and below, i.e. divided between the weight 31 and the tool support 5, and thus halved.

Figure 3:
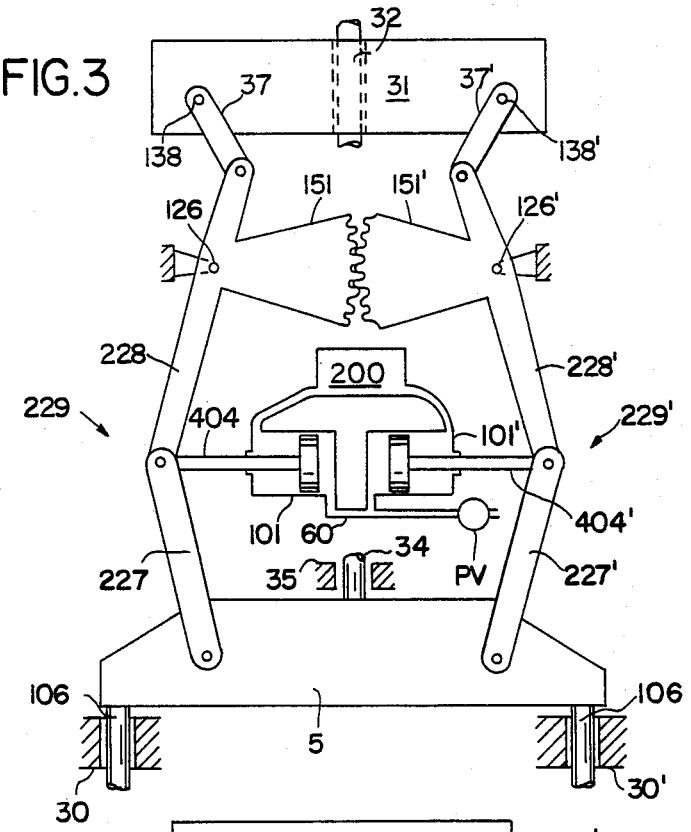
FIG. 3 shows a first embodiment for realizing the invention with the aid of centrally-arranged fluid linear drives (cylinder/piston units)
Figure 4:
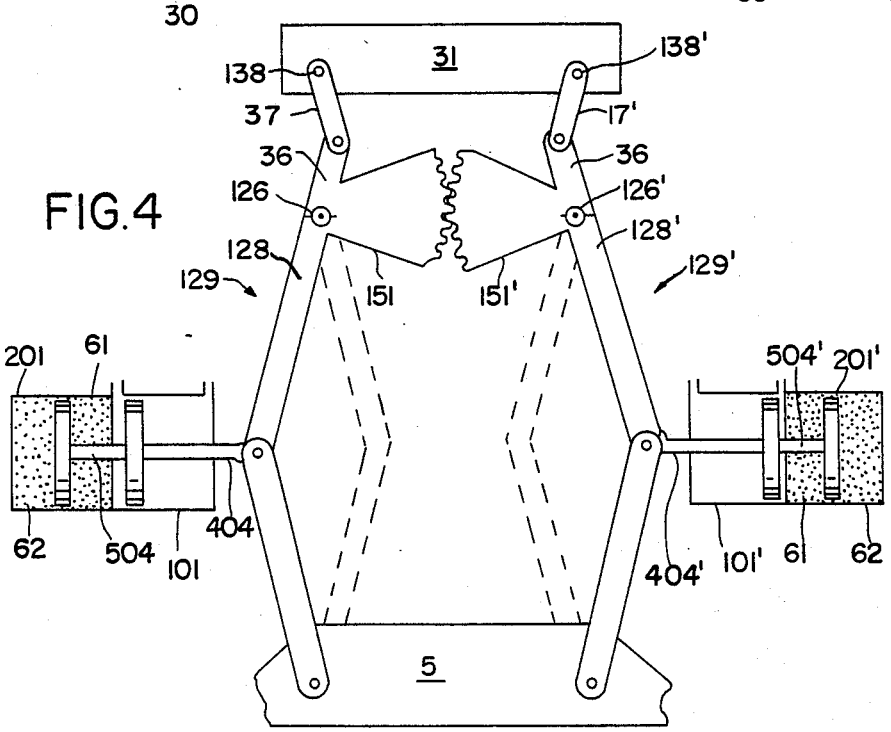
FIGS. 4 and 5 show further variants having differently positioned energy stores.
Figure 5:
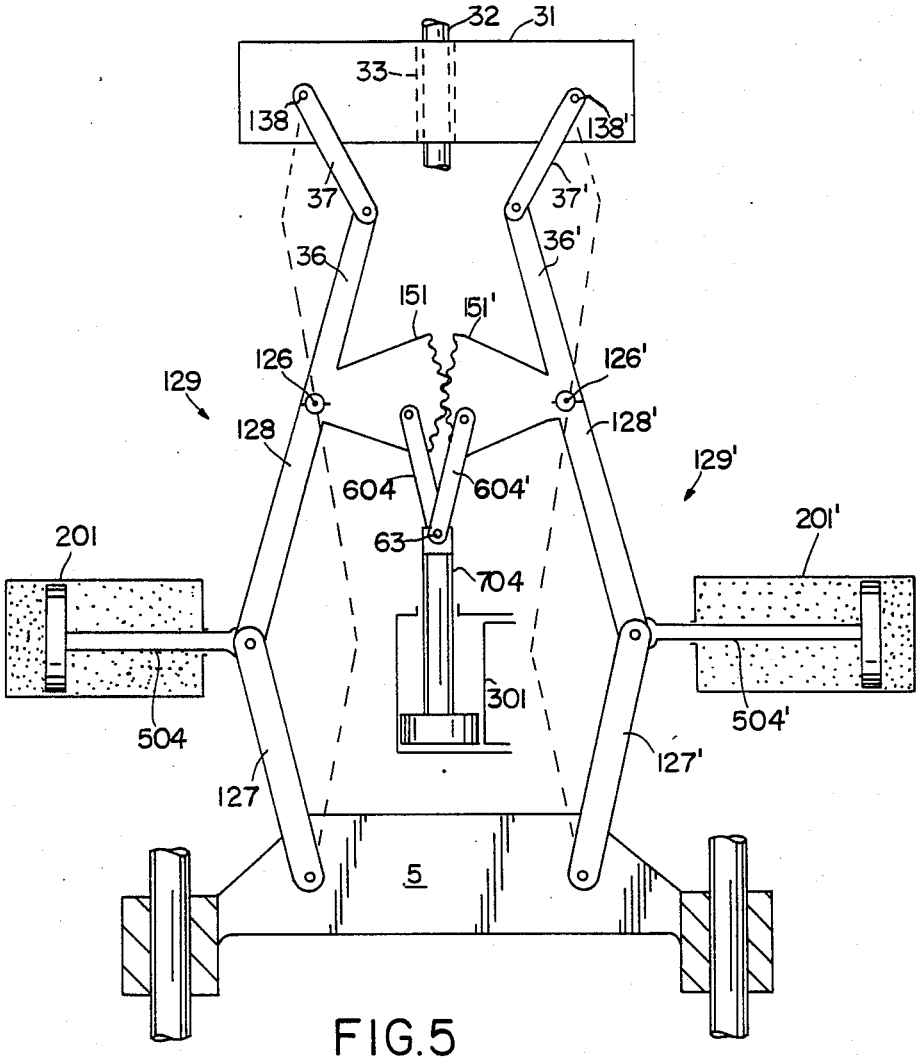

The essential difference between the construction according to FIGS. 3 to 5 and that according to FIG. 2 is that, instead of the bearing 26, 26' in the balancing weight 31, a stationary rocker bearing 126, 126' is provided for each toggle lever 129, 129'; 229, 229'. Thus, the total stroke transmitted by the connecting rods 404, 404'; 504, 504' acts on the tool support 5, which, in the example shown in FIG. 3, can incidentally also be provided with an additional guide column 34 on its upper side, the said guide column cooperating with a stationary guide 35.

However, in order to avoid having to dispense with a balancing weight 31 for this reason, the upper limbs 128, 128'; 228, 228' of the toggle levers 129, 129'; 229, 229' can be extended beyond the stationary pivot point 126, 126' and can have a short extension arm 36, 36'. A guide rod 37 or 37' is pivotable on each of these arms 36 or 36', respectively, the said guide rods theoretically representing only a thrust element but, in view of the high frequency of the punch press, is subjected to both tensile and compressive loads.

In this case too, a guide column 32 is once again provided for the balancing weight 31. It is not evident that this column 32 is fastened to a frame in retaining bushes 39. To permit free upward and downward movement of the weight 31, the frame has a recess.

Figure 1:
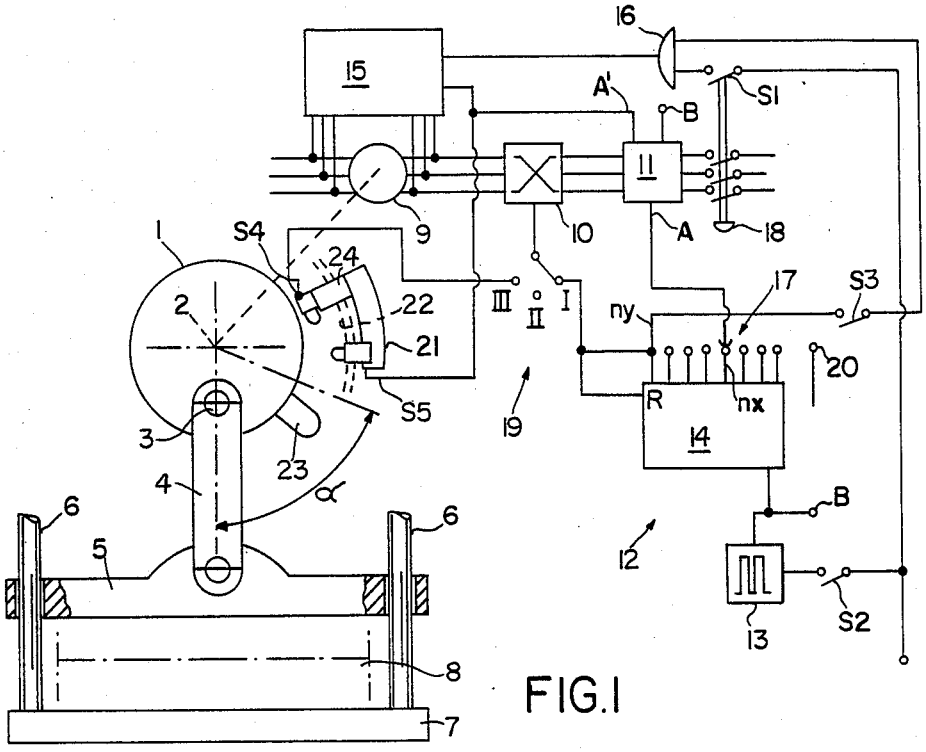
FIG. 1 shows a basic connection diagram with an electrical drive, the possible adjusting means also being shown.

In FIG. 1 an adjusting means 22 is indicated, by means of which not only the upper reversal point of the movable tool support 5 but also its bottom dead center is adjustable in height.

Another adjusting means, which is not shown, may have, for example, the following form: nuts having a thread are arranged over guide columns, the frame being provided with guide sleeves, each of which has a hole to accept the guide columns. The sleeves may have, in cross-section, a roughly rectangular outer contour whose longer side lies in a plane whereas the shorter side is at right angles to the plane. Thus, a cutout passes through at least one outer lateral surface of the sleeves, for example only the front surface, but if necessary also the rear lateral surface, so that the nuts project partially outward and can be adjusted from outside.

By rotating the nuts, the height of the frame can be adjusted; of course, the nuts must be adjusted in the same sense and by an equal extent. To facilitate this, they may possess a common adjustment drive which, for example, has a toothed system which is engaged by, for example, a chain, a toothed rod or a swivel drive.

For a punch press with extremely high punching frequency, an embodiment according to FIG. 2 is preferred. The connecting rods 104, 104' are relatively long and overlap one another during their passage through the dead center T. For this purpose, the two connecting rods 104, 104' are offset axially with respect to one another. It is clear that the arrangement of two crankshafts or eccentric shafts 1 which are parallel to one another and synchronized with one another has particular advantages with regard to housing the units for increased driving efficiency, regardless of whether the reciprocating drive is implemented or not. The arrangement in pairs furthermore results in a horizontal balance of the swinging masses, so that quiet running is also ensured and higher speeds are permitted and the effect of the energy store or stores is fully utilized. In the embodiment shown, this is further supported by the small number of force transmission elements and hinge points, resulting on the one hand in low masses and on the other hand in high precision, especially since none of the embodiments has any parts subject to bending stresses.

To illustrate the reciprocating rotary drive according to FIG. 1, which drive has already been mentioned several times, FIG. 1 shows only one crankshaft (drive 1) which is rotatable about a geometric axis 2, a connecting rod 4 being hinged to a crank pin 3. For the sake of simplicity, a movable tool support is shown directly connected at the opposite lower end of the connecting rod 4; in practice, a toggle lever system is also present in between here. The tool support 5 can be moved up and down along guide columns 6, which are connected to a stationary tool support 7. Both tool supports 5, 7 are designed in a manner known per se and not shown here, for fastening tools 8 indicated by dash-dot lines. These tools 8 lie next to one another at the bottom dead center of the crank pin 3 and approach one another very closely.

An eccentric shaft (drive 1) is capable of being driven by an electric motor 9. The shaft 1 has a diameter, or is provided with a wheel having a diameter, such that a rotation through 180° from the bottom dead center shown gives the maximum possible stroke in this punch press, this stroke being required only for centain tools, whereas in most cases a smaller stroke is sufficient.

Hence, to reduce the stroke on the one hand and thus also permit a higher punching frequency and on the other hand to be able to adapt the upper reversal point for the movable tool support to the requirements, the motor 9 operating in the motor mode and braking mode is provided with a reversing means 10 for the direction of rotation. In this way, it is possible to reverse the direction of rotation of the shaft (drive) 1 at a certain point.

It is important to determine this point as precisely as possible, the precision requirements for the upper "dead center" or reversal point being less stringent than those for the bottom dead center position shown in FIG. 1. For this purpose, the motor 9 has a rotor whose position is determined by the particular number of pulses which are fed to the motor 9. Such motors are either stepping motors or are synchronous or asynchronous motors—which are preferred owing to the better drive characteristics.

Accordingly, the motor 9 has an upcircuit limiting means 11, by means of which a predetermined number of pulses can be fed to the said motor. In order to determine this number exactly, a pulse generator 12 is provided for generating this predetermined number of pulses. Such an assembly may consist of mechanical/electrical elements (for example a trip cam which interacts with a switch and is stopped after the predetermined number of pulses) and may be an assembly involving relay technology or—as shown—a timing pulse generator 13 to which a counting stage 14 is connected.

The counting stage 14 possesses, in a conventional manner, a number of outputs, which are only indicated, and can be a decimal counter or a binary counter. One of its outputs, the output nx, is connected to a stop input A of the limiting means 11. This is the case if the counter 14 is a decimal counter, whereas in the case of a binary counter there is logically L at some outputs and "0" at other outputs for the number corresponding to the predetermined number of counts. In this latter case, it is necessary to connect all outputs via an AND gate to the limiting means 11, for example all outputs with the signal "L" directly and all outputs with the signal "0" via an inverter, so that only "L" signals are fed to the AND gate when the predetermined number is reached.

Thus, as soon as the counter 14 has reached the predetermined number, the motor current of the motor is switched off via the output nx. The arrangement may be such that a braking means in the form of a braking circuit 15 is switched on simultaneously and switches the motor 9 into the generator mode. However, it is also possible to allow the press to continue running under the action of its inertia and not to initiate braking until a short time later. This means that the current is switched off even before the upper reversal point is reached, braking being initiated only on reaching this reversal point.

This can be effected via an output ny of the counter 14, which on the one hand is connected to the braking means 15, advantageously via a gate circuit 16, and on the other hand to a reset input R, which causes the counter 14 to be switched to zero again and then to begin a new count. Furthermore, the last output of the counter 14, i.e. the output ny, which corresponds to the highest number and hence to the predetermined uppermost position of the tool support 5, is also connected to the reversal means 10 which is in the form of a rotation reversal stage, so that, as the counter 14 continues to count, the same distance is covered by the eccentric shaft, but now in the opposite direction.

With regard to the "same distance", every skilled worker knows that exact positioning is possible in particular using stepping motors. Such motors could in theory be used here but they generally have smaller start-up torques than, for example, synchronous or asynchronous motors. As a result, the very critical bottom dead center in the instruction described is determined by the lowest position of the crank pin 3, and, in the region of the culmination point of sine curve, small deviations along the curve scarcely produce any change in the position of the movable tool support 5. It is therefore possible to use the synchronous or asynchronous motors, which cannot be braked so accurately but have better torque characteristics.

The path traveled to and fro by the crankshaft (drive) 1 is plotted as angle $\alpha$. Of course, in many cases (not in all cases) it is desirable to be able to adjust this angle $\alpha$. Thus, for variable restriction of the stroke of the tool support 5, an adjusting means is expediently provided. In the embodiment shown, such an adjusting means can be provided if the outputs of the counter 14 can be connected alternatively to the stages 10, 11 and 15, so that they can be put into operation in each case as a function of the particular output connected and the counter value corresponding to it. It would also be possible to provide a plurality of counting stages instead of a single counter 14, each counting stage corresponding to a different maximum count and hence to a different angle α.

FIG. 1 in any case indicates that the stop input A of the limiting means 11 can be connected to various outputs of the counter 14 via an adjusting means 17 in the form of a sliding contact, and, analogously, the reset input R, the input of the reversal means 10 and the braking means 15 can be connected via a further sliding contact (not shown) alternatively to different outputs.

The gate circuit 16, one of whose inputs is formed by the output ny of the counting stage 14, has already been mentioned. The other input may be led via a switch reed S1 connected to the main switch 18 for the motor current of the motor 9, or a switch reed S2, via which the time pulse generator 13 can be switched on simultaneously with the motor 9, may be connected to this main switch 18 (in a manner not shown). The braking means 15 too can be tilted into its braking state only when motor 9 is switched on.

From the above explanation, the following should be singled out: it is clear that the circuit described provides a reciprocating drive, by means of which the upper dead center of the tool support 5 can easily be adjusted. Of course, this drive as such can be replaced by equivalent drives, although the drive shown or described is distinguished by low mass and high performance, especially because of the good cooperation with the energy store. Selection of the various stages 10, 11 and 15 is effected here by an electronic program controller, although it is of course also possible to employ other known program controllers for this purpose. For example, it will be possible to provide a microprocessor for this purpose, which could then, if required, undertake additional control tasks. The desired angle α can then be input in a particularly simple manner via a key device.

While feedback via sensors is not necessary in a step control as described above, a program controller may also contain such sensors in the form of position transmitters. For this purpose, a switch S3 can interrupt the control of the braking means 15 via the counter 14. A selector 19, which is coordinated with three switch positions, is also provided. In the position I shown, operation takes place in the manner described above; in the position II, the direction of rotation cannot be reversed, i.e. the motor 9 rotates continuously in one direction, in other words performs at least one revolution through 360°.

For this function, the adjusting means 17 in the form of a sliding contact is brought into a position 20 so that the stage 11 can no longer receive a switch-off signal, while on the other hand it continues (as in the function for position I of the adjusting means 19) to be connected via a terminal B to the time pulse generator 13 and can receive pulses from it. This circuit with the terminal B can, however, be dispensed with if the pulse frequency of the time pulse generator 13 is tuned to, or even synchronized with, the mains frequency, so that the number of pulses fed to the motor 9—in conformity with that of the time pulse generator 13—originates from the mains.

In the position III, on the other hand, the limiting means 11 is connected to a position transmitter switch S4. Another position transmitter switch S5 is arranged an adjustable distance upcircuit of the switch S4. In principle, however, both switches S4, S5 are connected to one another by a bow 21 and can be displaced together along an adjusting means 22—in the form of a guide indicated by a dashed line—to adjust the angle α. If such a control is desired, the drive 1 is provided with a radial stop 23 which, when moving along its path, actuates the switch S5 and on the one hand gives a signal via this switch to a stop input A' (it may also be A) of the limiting means 11 for the motor 9 in order to interrupt its power supply, and on the other hand also causes the braking means 15 to switch the motor 9 to the generator mode.

After the motor 9 has come to a stop, i.e. when it no longer produces any current, the braking means 15 automatically switches over to "motor mode" again in the manner of a monostable trigger circuit, without requiring a special signal for this purpose. To achieve this, it can, for example, be equipped with a self-holding circuit which is held by a relay (which is fed by the current of the motor 9) until this current falls to zero.

As soon as this braking has been triggered via the switch S5, the crankshaft may move a little further under the influence of the inertial forces, although this distance may be very short, particularly if, in addition to the electrical braking means 15, a mechanical brake is provided. If the crank pin 3 is fastened to a disk which can be rotated about the axis 2, a magnetically controlled disk brake triggered via the switch S5 (or the output ny of the counter 14) can engage this disk.

For safety reasons, the stop extension 23 may come to rest, at the end of its movement, against an adjustable stop 24, while at the same time the direction of rotation is reversed by means of the switch S4. A similar arrangement having two switches which correspond to the switches S4, S5 can then be provided, in a manner not shown, for the reverse movement.

Instead of a reciprocating rotary drive, it is of course also possible to use a linear drive of this type, in particular having fluid (in general hydraulic) cylinder/piston units 101, 101'; 301 (FIGS. 3–5), tumble-free movement characteristics likewise being obtained if the two drives are synchronized with one another.

In FIG. 3, two toggle levers 229, 229' are provided, each of which consists of a limb 228, 228' which is hinged in a stationary manner in a bearing 126, 126' and another limb 227, 227'. The movable tool support 5 is guided with narrow tolerances by means of fixed guides 30, 30' in the frame and guide columns 106. The toggle lever limbs 228, 228' which are hinged at a stationary position are extended or bent and widened to form toothed segments 151, 151', the toothed segments 151, 151' ensuring synchronization even when the control line 60 which supplies the cylinders 101, 101' with hydraulic medium and is led from a control valve PV (for example a proportional valve) has slight irregularities or is partially blocked.

As shown, the control line 60 enters the cylinder 101, 101' on that side which faces away from the piston rod 404 or 404', although control on the opposite side or on both sides would also be possible. The other side in each case is provided with a connection for an accumulator 200.

A balancing weight 31, which is virtually indispensible in high frequency punch presses with a punching frequency above about 400 strokes/minute, can be fastened to the extensions of the limbs 228, 228', i.e. to the segments 151, 151', expediently via guide rods 37, 37', in a manner similar to that in FIGS. 4 and 5 with the upward-projecting extensions of the limbs of the toggle levers, which limbs are hinged at a stationary position.

The control valve PV may be of a conventional design, and a large number of valves for such purposes are available on the market. This not only permits a uniform, tumble-free sequence of movements but also allows the speed to be changed by varying the flow rate of hydraulic medium during the stroke, in order in this way to obtain the desired overall characteristic of the movement. This is particularly important if smooth punched edges are to be achieved, for which purpose a large number of coupled gears have been proposed in precision punch technology; these gears are not required at all in the drive version described.

Certain disadvantages of flywheels which are usually provided in punch presses in order to supply the necessary energy for the punch cut have been repeatedly pointed out above. The flywheels were always justified by the fact that they enable the drives to be kept small. The use of the principle according to the invention dispenses with the flywheels without having to make the drive excessively large as a result, which—because of the associated mass—would give rise to disadvantages with regard to the maximum acceleration of this mass to be achieved. FIGS. 4 and 5 show how fluid energy stores 201, 201' can also be used for this purpose; the said energy stores on the one hand can readily have a small mass and on the other hand require no coupling.

The accumulators 201, 201' possess, in the usual manner, cylinder spaces 61 and 62 filled with compressed gas (FIG. 4). The gas is compressed in the spaces 61 and is let down in the spaces 62 when the pistons of the drives 101, 101' move from the middle into the interior of the machine. The compressed gas then forces the toggle levers and the tool support 5 in the opposite direction again on expanding.

The use of such energy stores 201, 201' is not limited to fluid drives or linear drives; instead, they can advantageously be used generally also for rotary drives, i.e. both in drives according to the embodiments discussed above and in any rotary drives. Such energy stores are particularly recommended for a linear drive.

In rotating drives, it is therefore advantageous to use an electric motor operating in the so-called four-quadrant mode.

It may also be mentioned that the counterweight 31 in this case is shown merely symbolically and could of course in principle be arranged as desired.

The more advantageous arrangement of two accumulators 201, 201' described above is shown in FIG. 5, since it is preferable if the drive is located in the center between the two toggle levers 129, 129', in order in this way to obtain a more compact construction. In the embodiment according to FIG. 5, the two accumulators 201, 201' serve, during the stroke, as a drive for accelerating the masses and for absorbing braking energy after the punching operation until the tool support 5 stops; however, a control drive in the form of a cylinder/piston drive 301 is also provided and is arranged between the two toggle levers 129, 129'. Its function is to reverse the piston movement at preselectable stopping points, i.e. to determine the stroke through suitable control. Although this drive 301 possesses only a single piston rod 704, two rods 604, 604' are mechanically coupled to the said piston rod by an articulated rod pin 63, so that synchronous drive of the toothed segments 151, 151' from this side is ensured. However, the toothed segments 151, 151' additionally ensure here the synchronous movement during the stroke supported by the accumulator 201, 201'.

Preferably, the upper dead center is reached as a result of the toggle levers swaying to the left and right from the straight position (bottom dead center).

The invention embraces a large number of combinations of the features described, with one another and with prior art features; since every tool support is in general rectangular in plan view, instead of two toggle levers it is also possible, for example, to provide four toggle levers, each of which engages at a corner of the rectangle or in the region of a corner. In the case of FIGS. 3 to 5, it is also possible to provide arc-shaped crosshead guides instead of the linear guides. In theory, a horizontal arrangement of the guide columns 6 would also be possible, and the expressions "top" or "bottom" used in the description only have a relative meaning and relate merely to the examples, especially since an inverted arrangement could also be implemented.

Of course, the step-by-step system shown in FIG. 1 is only an example. Alternatively, increment generators can be attached to the relevant shaft and used to form a feedback signal. In another possible method, hydraulic motors can be used for the reciprocating drive, and the operating force of the tool support can be adjusted by adjusting the pressure. Furthermore, the power supplied to the electric motors can be adjustable in order to adjust the operating force.

REFERENCE SYMBOLS

1: Reciprocating drives (101, 101', 201, 301)
2: Geometric axis
3: Crank pin 3'
4: Rod (104, 140', 404, 404', 504, 504', 604, 604', 704)
5: Tool support
6: Guide columns
7: Tool support
8: Tools
9: Electric motor
10: Reversing means
11: Limiting means
12: Pulse generator
13: Timing pulse generator
14: Counter
15: Handbrake means
16: Gate circuit
17: Adjusting means
18: Main switch
19: Selector
20: Position
21: Bow
22: Adjusting means
23: Stop extension
24: Stop
25: Crosshead 35'
26: Bearing 26'
29: Toggle levers 29', 129, 129', 229, 229'
30: Guide
31: Balancing weight
32: Guide column
33: Orifice
34: Guide column
35: Stationary guide
36: Extension arm 36'
37: Guide rod 27'
60: Control line
63: Articulated rod pin
104: Rod 104'

106: Column
126: Stationary pivot point 126'
137: Guide rod 137'
138: Centers of pressure 138'
151: Toothed segments 151'
200: Accumulators 202, 201'
227: Other limbs 227'
228: Toggle lever limbs 228', 128, 128'
nx: Output
R: Reset input
ny: Output
S4: Position transmittor switch
B: Terminal
S3: Switch
S1: Switch reed
S2: Switch reed
A: Stop input A'
S4: Limiting means
S5: Limiting means
α: Angular range
PV: Valve arrangement
T: Crankshaft dead center

I claim:

1. A press drive for two tool supports which are displaceable relative to one another, at least one of which is driven by means of at least two toggle levers, each having two dead center positions, each of said toggle levers being driven and braked by at least one respective drive energy source by means of at least one respective connecting rod, at least one dead center position of the toggle levers corresponding to the closest approach to each other of said tool supports which are displaceable relative to one another, the toggle levers having knee joints which bend symmetrically in opposite directions, and the drive energy sources being synchronized with one another via a synchronizing arrangement, wherein each of the drive energy sources comprises an energy store of the non-flywheel type, the energy store being adapted to release stored energy when driving said toggle levers in order to accelerate the tool supports, and to store braking energy when braking said toggle levers during braking of the tool supports.

2. A drive as claimed in claim 1, wherein the energy store comprises an accumulator.

3. A drive as claimed in claim 1, wherein the drive energy sources each comprise a reciprocating drive.

4. A drive as claimed in claim 3, wherein each drive has a shaft which is rotatable and whose rotation is limited by at least one limiting means, over a predetermined angular range (α) both sides of the dead center corresponding to the closest approach of the tool supports.

5. A drive as claimed in claim 4, wherein the limiting means are coordinated with a stroke length adjusting means.

6. A drive as claimed in claim 5, wherein the limiting means comprise braking means.

7. A drive as claimed in claim 3, wherein said reciprocating drives comprise at least one reversible electric motor having a rotor with a pulse-dependent position and a pulse generator which is coordinated with a reversal means for reversing the direction of rotation.

8. A drive as claimed in claim 7, wherein the pulse generator has an adjusting means for changing the number of pulses supplied to the electric motor and a counter, a time pulse generator being connected to said counter.

9. A drive as claimed in claim 7, wherein the reversal means has a switching means for switching over the electric motor to a generator mode to brake it, and a selector for optional rotation in only one direction over a full 360°.

10. A drive as claimed in claim 3, wherein the reciprocating drive comprises at least one reversible hydraulic motor which is controllable by means of at least one valve arrangement.

11. A drive as claimed in claim 3, wherein the reciprocating drive comprises at least one fluid-driven cylinder-piston combination, and the energy store comprises an accumulator.

12. A drive as claimed in claim 1, wherein the drive energy sources are arranged at a location between said two toggle levers.

13. A drive as claimed in claim 1, wherein the knee joints of the two symmetrically arranged toggle levers are guided by means of crossheads which impart energy to, and receive energy from, the energy store.

14. A drive as claimed in claim 3, wherein the toggle levers are pivotally mounted at an essentially stationary mounting position in a region of a first toggle lever limb and are connected to one of the two tool supports via a free end of a second limb hinged to said first limb at said knee joint, and wherein the first limb hinged at said essentially stationary mounting position is extended beyond its stationary mounting position and engages, via a guide rod, a balancing weight which is movable along a linear guide.

15. A drive as claimed in claim 3, wherein the toggle levers are pivotally mounted at an essentially stationary mounting position in a region of a first toggle lever limb and are connected to one of the two tool supports via a free end of a second limb hinged to said first limb at said knee joint, and wherein the toggle lever limbs are connected to a common balancing weight, the toggle levers being arranged symmetrically with respect to the center of gravity of the said weight.

16. A drive as claimed in claim 1, wherein the toggle levers are pivotally mounted at an essentially stationary mounting position in a region of a first toggle lever limb and are connected to one of the two tool supports via a free end of a second limb hinged to said first limb at said knee joint, and wherein the stationary mounting position and the drive energy sources are arranged on a common frame at a location which is adjustable by an adjusting means for adjusting the closest approach of the two tool supports to each other in their direction of movement.

17. A drive as claimed in claim 1, wherein said connecting rods overlap one another on a rotary drive, and at least one crankshaft or eccentric shaft being axially offset and arranged symmetrically with respect to a plane passing through the crankshaft or eccentric shaft of the rotary drive.

18. A drive as claimed in claim 17, wherein each of said connecting rods is connected to said crankshaft or eccentric shaft which faces away from the corresponding toggle lever and at least one of the said shafts being a motor shaft.

19. A drive as claimed in claim 9, wherein said selector is connected to the switching means.

20. A press drive for two tool supports which are displaceable relative to one another, at least one of which is driven by means of at least two toggle levers, each having two dead center positions, each of said toggle levers being driven and braked by at least one respective drive energy source by means of at least one respective connecting rod, at least one dead center position of the toggle levers corresponding to the closest approach to each other of said tool supports which are displaceable relative to one another, the toggle levers having knee joints which bend symmetrically in opposite directions, and the drive energy sources being synchronized with one another via a synchronizing arrangement, wherein each of the drive energy sources comprises a reciprocating drive and an energy store, the energy store being adapted to release stored energy when driving said toggle levers in order to accelerate the tool supports, and to store braking energy when braking said toggle levers during braking of the tool supports.

21. A drive as claimed in claim 20, wherein each drive has a shaft which is rotatable and whose rotation is limited by at least one limiting means, over a predetermined angular range ($\alpha$) both sides of the dead center corresponding to the closest approach of the tool supports.

22. A drive as claimed in claim 21, wherein the limiting means are coordinated with a stroke length adjusting means.

23. A drive as claimed in claim 22, wherein the limiting means comprise braking means.

24. A drive as claimed in claim 20, wherein said reciprocating drives comprise at least one reversible electric motor having a rotor with a pulse-dependent position and a pulse generator which is coordinated with a reversal means for reversing the direction of rotation.

25. A drive as claimed in claim 24, wherein the pulse generator has an adjusting means for changing the number of pulses supplied to the electric motor and a counter, a time pulse generator being connected to said counter.

26. A drive as claimed in claim 24, wherein the reversal means has a switching means for switching over the electric motor to a generator mode to brake it, and a selector for optional rotation in only one direction over a full 360°.

27. A drive as claimed in claim 26, wherein said selector is connected to the switching means.

28. A drive as claimed in claim 1, wherein the energy store is of the fluid-pressure type.

29. A drive as claimed in claim 20, wherein the energy store is of the fluid-pressure type.

* * * * *